US009995542B1

(12) United States Patent
Sahin et al.

(10) Patent No.: US 9,995,542 B1
(45) Date of Patent: Jun. 12, 2018

(54) ROTATING HEAD ASSEMBLY FOR USE WITH THE BOLT ASSEMBLY OF A GUN

(71) Applicant: RETAY SILAH OTOMOTIV INSAAT VE GIDA SANAYI VE TICARET LIMITED SIRKETI, Karatay, Konya (TR)

(72) Inventors: Adem Sahin, Konya (TR); Hasan Kepez, Konya (TR)

(73) Assignee: RETAY SILAH OTOMOTIV INSAAT VE GIDA SANAYI VE TICARET LIMITED SIRKETI, Konya (TR)

( * ) Notice: Subject to any disclaimer, the term of this patent is extended or adjusted under 35 U.S.C. 154(b) by 0 days. days.

(21) Appl. No.: 15/616,063

(22) Filed: Jun. 7, 2017

(51) Int. Cl.
*F41A 3/16* (2006.01)
*F41C 7/00* (2006.01)

(52) U.S. Cl.
CPC . *F41A 3/16* (2013.01); *F41C 7/00* (2013.01)

(58) Field of Classification Search
CPC ..... F41A 3/16; F41A 3/26; F41A 3/28; F41A 3/30
See application file for complete search history.

(56) References Cited

U.S. PATENT DOCUMENTS 6,101,919 A * 8/2000 Murello ..... F41A 3/26 42/16
2014/0251118 A1* 9/2014 Moretti ..... F41A 3/20 89/23

FOREIGN PATENT DOCUMENTS

DE 708197 * 7/1941
EP 2775251 A1 9/2014

* cited by examiner

*Primary Examiner* — Stephen Johnson
(74) *Attorney, Agent, or Firm* — Egbert Law Offices, PLLC

(57) ABSTRACT

The invention pertains to the rotating head (20) found in the bolt action assembly (A) of the gas-operated, recoil-operated, or bolt action, or lever-action hunting shotguns and is characterized in that it pertains to a fixing shaft (13) with a fixing plane (14) formed at the end of the cam action groove (12) located on the body (10) of the bolt action (A), a spring shaft (22) formed on the rotating head (20) positioned within the passage hole (11) located in the body (10) of the bolt action (A), a mounting hole (23) formed in the spring shaft (22) on the rotating head (20) positioned within the passage hole (11) located in the body (10) of the bolt action (A), a rotation spring (30) with a mounting lug (31) located at one end and a fixing lug (32) at the other end.

1 Claim, 5 Drawing Sheets

ROTATING HEAD ASSEMBLY FOR USE WITH THE BOLT ASSEMBLY OF A GUN

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The invention pertains to the rotating head found in the bolt assembly of the gas-operated, recoil-operated, or bolt action, or lever-action hunting shotguns.

By fixing the rotating head found in the bolt assembly of the gas-operated, recoil-operated, or bolt action, or lever-action hunting shotguns in order to keep the shotguns ready for firing, the invention specifically pertains to the structure of:

- an elongated opening with a fixing plane formed at the breech of the cam action groove located in the body of the bolt action,
- a spring groove formed on the rotating head positioned in the passage hole located in the body of the bolt action,
- a mounting hole formed in the groove on the rotating head positioned in the passage hole located in the body of the bolt action,
- a rotation spring providing the locking of the rotation head in the body together with the fixing lug touching the fixing plane located at the other end upon the movement of the rotating head within the cam action groove positioned within the groove by passing from the mounting lug at one end to the mounting hole on the rotation head, hence providing the firing position of the shotguns to be ready.

2. Description of Related Art Including Information Disclosed Under 37 CFR 1.97 and 37 CFR 1.98

Currently gas-operated or recoil-operated, or bolt action, or lever-action hunting shotguns are available. The process of preparing the hunting shotguns for firing is realized by the bolt operating in the cap located between the magazine and the barrel.

The bolt of the hunting shotguns consists of the body and the rotating head. The rotating head realizes the locking of the cartridge by engaging to the locking seats in the cap and provides the shotguns to be ready in a firing position while ejecting the empty cartridge from the shotgun by moving the bolt backwards first and then sharply pushing it forward to load the full cartridge to the chamber.

In the prior art as mentioned above, upon providing the bolt action of the hunting shotguns to be ready for firing, the shotgun can be subjected to impacts caused by the hunter bending or jumping over rough terrain in the surrounding while advancing in the hunting ground. In that case, the rotating head slightly moves backwards within the body. Thus, the shotgun remains disabled and the trigger is not squeezed even if the hunter pulls the trigger and the shotgun is not fired.

In this case the hunter moves the bolt action backwards and swiftly pushes it forward again. At this stage the game flees because of the noise made.

The patent application numbered EP2775251 with the invention title "Bolt assembly with improved rotating locking head" developed in order to solve the aforementioned problem in the prior art has been come across. In the abstract section of the relevant application, it is indicated that; "A bolt assembly with improved rotating locking head, comprising a rotating locking head associated with a bolt body and movable with respect to the bolt body with a combined rotary and translational motion; the rotating locking head having at least two working positions: a closed position, wherein the rotating head closes the breech of the firearm, and an open position, wherein the rotating head is at a distance from the breech; the bolt assembly has an auxiliary pusher that biases the rotating head from the open position to the closed position.

When reviewing the abstract section and the content of the subject application, it has been observed that the process of locking the rotation head to the body is realized by the spring placed into a hole and the ball located at the upper part of the spring coming into contact with the rotation head.

As a result, a requirement for improvement arises due to the problems faced in the state of the art and explained above.

BRIEF SUMMARY OF THE INVENTION

Due to the problems in the prior art, the object of the invention is to solve all of the aforementioned problems.

The object of the invention is to realize the fixing process of the rotating head found in the bolt assembly of the gas-operated, recoil-operated, or bolt action, or lever-action hunting shotguns.

A further object of the invention is to realize the fixing process of the rotating head found in the bolt assembly of the gas-operated, recoil-operated, or bolt action, or lever-action hunting shotguns in order to keep the shotgun ready for firing, structured to:

- an elongated opening with a fixing plane formed at the breech of the cam action groove located in the body of the bolt assembly,
- a groove formed on the rotating head positioned in the passage hole located in the body of the bolt assembly,
- a mounting hole formed in the groove on the rotating head positioned in the passage hole located in the body of the bolt action,
- a rotation spring providing the locking of the rotation head in the body together with the fixing lug touching the fixing plane located at the other end upon the movement of the rotating head within the cam action groove positioned within the groove by passing from the mounting lug at one end to the mounting hole on the rotation head, hence allowing the firing position of the shotgun to be ready.

DETAILED DESCRIPTION OF THE INVENTION

Figure 1:
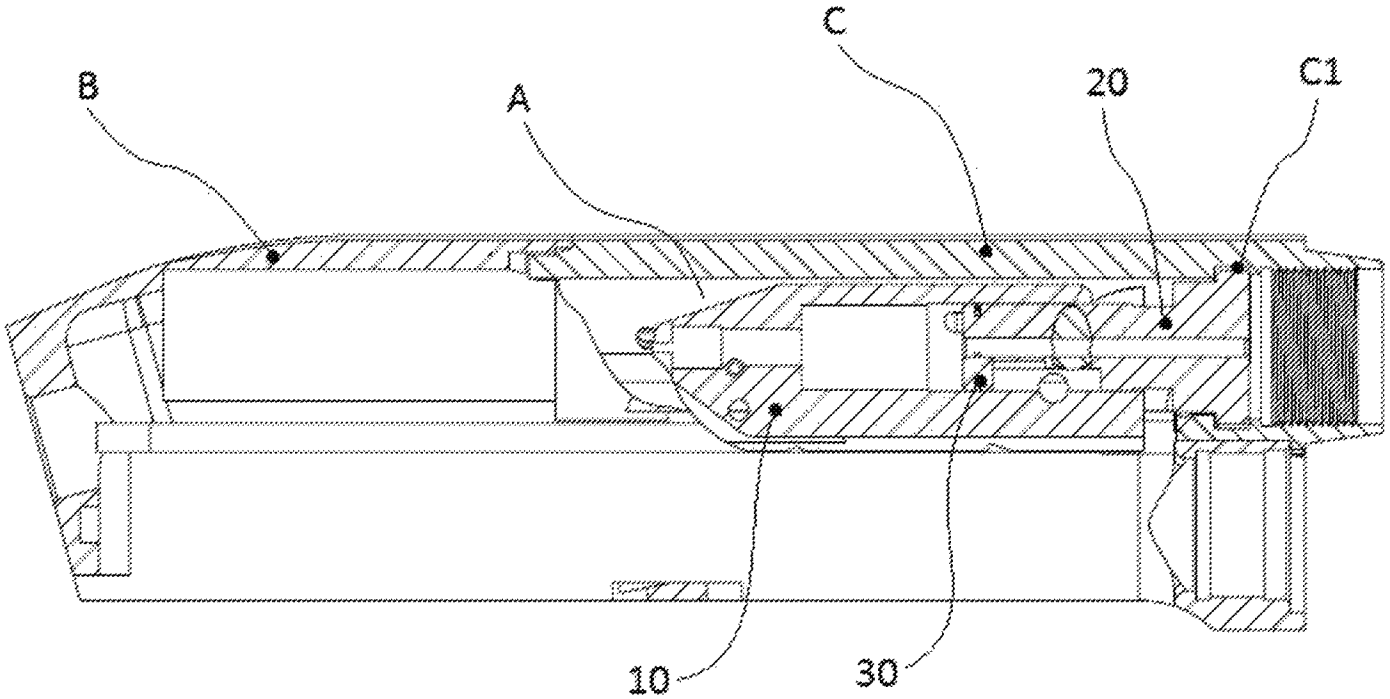
FIG. 1 is a representative side view of the partial section of the cap and bolt action of the hunting shotgun assembled together.
Figure 2:
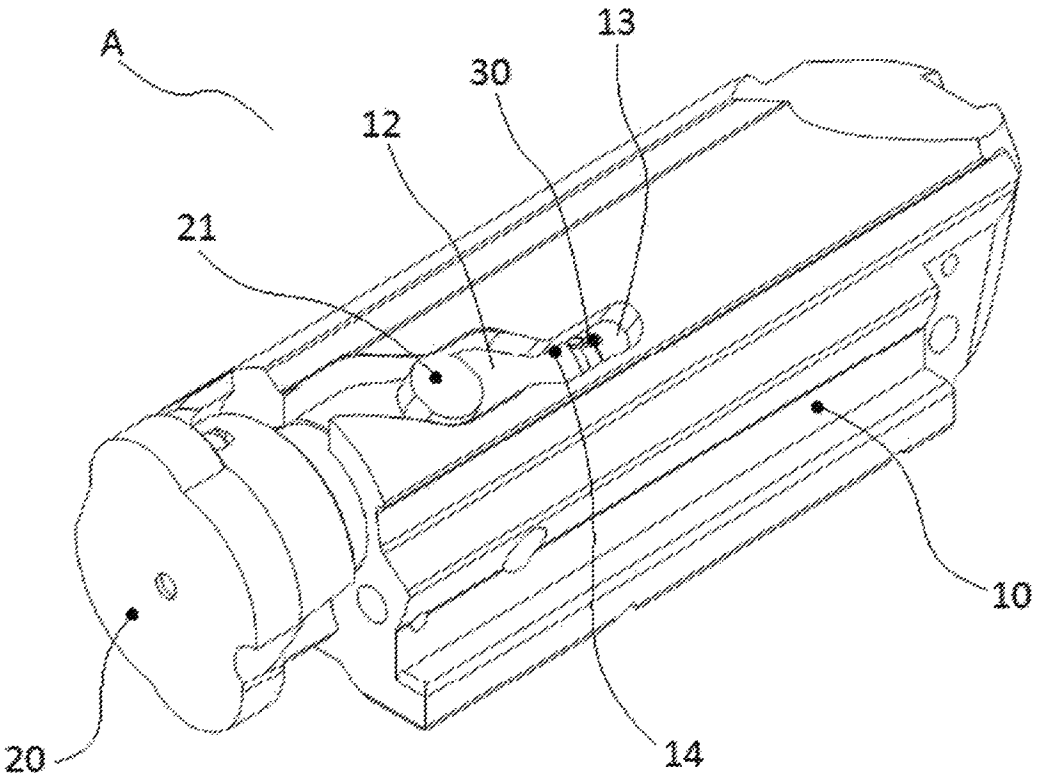
FIG. 2 is a representative perspective view of the bolt assembly locked to the rotating head body.
Figure 3:
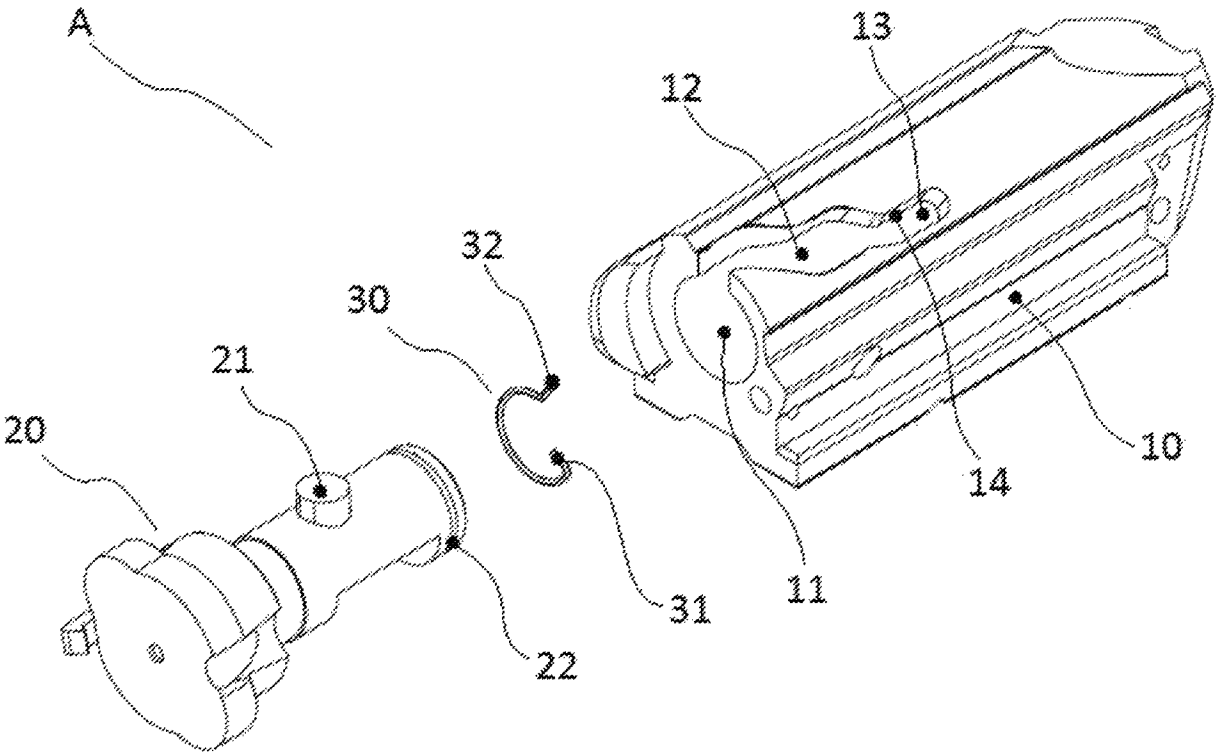
FIG. 3 is a representative view of the disassembled bolt assembly.

FIG. 1 shows a representative side view of a partial section of the assembled case (B), cap (C) and a bolt action (A) within the cap (C) of a hunting shotgun.

The process of preparing the hunting shotguns to be ready for firing is realized by the bolt action (A) within the cap (C) positioned between the case (B) and the barrel.

The bolt assembly (A) of the hunting shotguns comprises a body (10), a rotating head (20) and a rotation spring (30) subject to the invention.

During the production process, the following has been formed on the body (10):

- a passage hole (11) positioning the rotating head (20);
- a cam action groove (12) wherein the helical cam follower (21) located in the rotating head (20) moves;
- an elongated opening (13) with a fixing plane (14) subject to the invention at the breech of the cam action groove (12).

In the production process of the rotating head (20) realizing the locking process of the cartridge within the cartridge chamber by positioning it to the passage hole (11) located in the body (10):

- the helical cam follower (21) on its cylindrical structure;
- the inventive circular spring retaining groove (22), towards the breech of the helical cam follower (21) region, mounting hole (23) vertical to the spring retaining groove (22) are formed.

An inventive rotation spring (30) positioned within the spring retaining groove (22) formed in the rotating head has been produced. The rotation spring (30) generally is of a circular shape and has a mounting lug (31) straight towards the centre at one end and a fixing lug (32) straight outwards at the other end.

The inventive rotation spring (30) of the bolt action (A) as stated above is positioned within the spring retaining groove (22) formed in the rotating head (20) upon the production process. In this process, the mounting lug (31) located on the rotation spring (30) is engaged to the mounting hole (23) located on the spring retaining groove (22). The rotating head (20) is engaged to the body (10) after the rotation spring (30) is mounted. In this process, the helical cam follower (21) in the rotating head (20) engages to the cam action groove (12). Upon completion of the assembly process of the bolt action (A), the cap (C) is mounted to the case (B) by positioning the cap (C) within.

Figure 4:
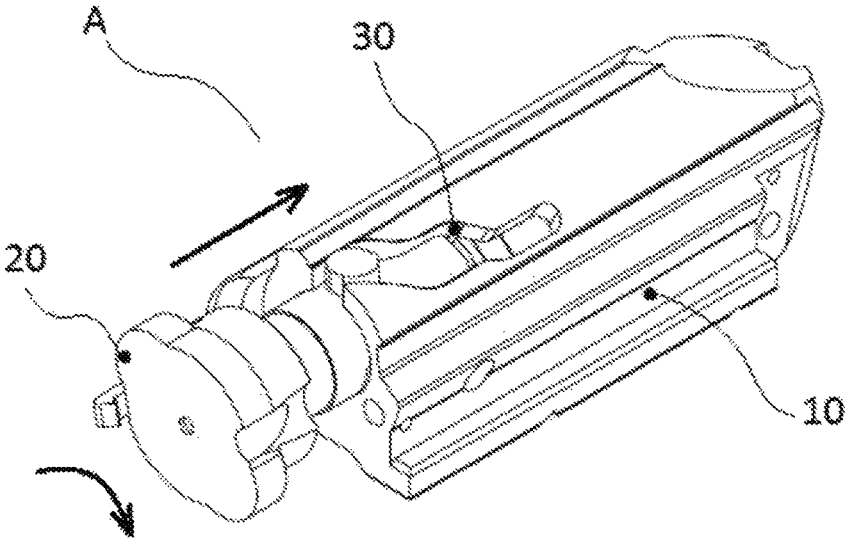
FIG. 4 is a representative perspective view of the bolt assembly, the rotating head of which is mounted to the body.
Figure 5:
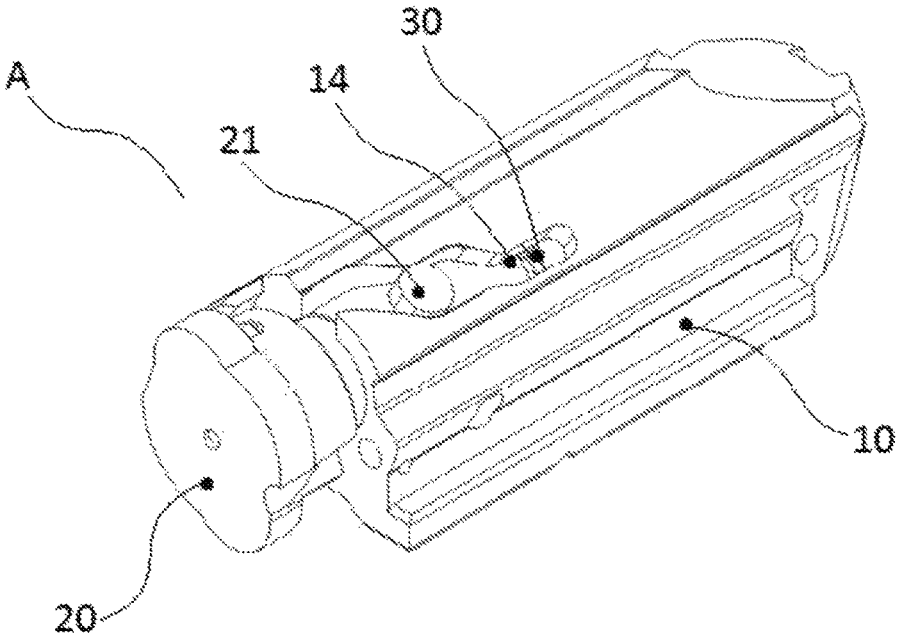
FIG. 5 is a representative perspective view of the bolt assembly, the rotating head of which is locked to the body.
Figure 6:
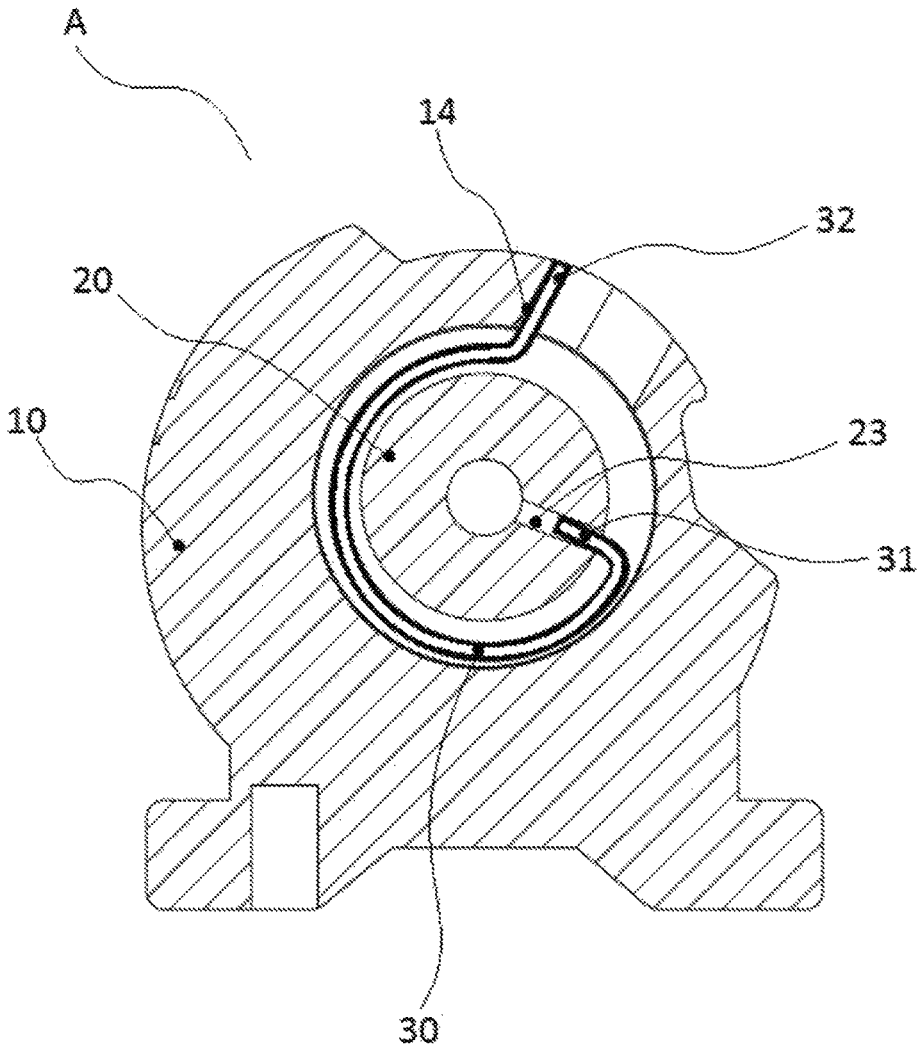
FIG. 6 is a representative cross section view of the bolt action, the rotating head of which is mounted to the body.

The action of the inventive rotation spring (30) is shown in 4 and 5. In this process the hunter moves the bolt action backwards and swiftly pushes it forward. The helical cam follower (21) moves within the cam action groove (12) as shown in FIG. 4, by the view of the bolt action (A) while being moved backwards. At the same time, the fixing lug (32) located within the rotation spring (30) also moves within the cam action groove (12). The helical cam follower (21) moves forward in the cam action groove (12) upon the process of the bolt action (A) being swiftly pushed forward. The helical cam follower (21) together with the rotation spring (30) rotates the rotating head (20). The fixing lug (32) during the rotation process advances within the elongated opening (13) ensuring the rotating head (20) remains stretched, thus is fixed by engaging to the fixing plane (14) as seen in FIGS. 5 and 6. At this stage the rotating head (20) engages to the locking seat (C1) and ensures the cartridge to be locked within the cartridge chamber.

The inventive elongated opening (13) with the fixing plane (14), the spring retaining groove (22), the mounting hole (23) and rotation spring (30) can be implemented for gas- or, recoil-operated, or bolt action, or lever-action hunting shotguns.

By means of the inventive elongated opening (13) with the fixing plane (14), the spring elongated opening (22), the mounting hole (23) and rotation spring (30):

- as the rotating head (20) is fixed to the body (10) following the impacts that may occur on the shotgun during the movement of the hunter on the hunting ground, the shotgun remains ready for firing. As the rotating head (20) is fixed, the forward and backward movement of the bolt assembly (A) is not required, thus the fleeing of the game is eliminated.

We claim:

1. An apparatus comprising:

a bolt action of a gun, said bolt action having a rotating head, the rotating head comprising:

an elongated opening having a fixing plane formed at an end of a cam action groove of a body of said bolt action;

a groove formed on the rotating head and positioned within a passage hole on the body of said bolt action;

a mounting hole formed in said groove on said rotating head; and a rotation spring positioned within said groove by engaging a mounting lug at one end to said mounting hole so as to fix the rotating head onto the body by a fixing lug and having another end engaging the fixing plane upon movement of the rotating head within the cam action groove so as to make the gun ready for firing.

* * * * *